US008188818B2

(12) United States Patent
Cho et al.

(10) Patent No.: US 8,188,818 B2
(45) Date of Patent: May 29, 2012

(54) RELAY

(75) Inventors: Hyun Kil Cho, Daejeon (KR); Yeong Bong Kim, Cheongju (KR)

(73) Assignee: LS Industrial Systems Co., Ltd., Anyang-Si (KR)

( * ) Notice: Subject to any disclaimer, the term of this patent is extended or adjusted under 35 U.S.C. 154(b) by 226 days.

(21) Appl. No.: 12/503,015

(22) Filed: Jul. 14, 2009

(65) Prior Publication Data

US 2010/0060392 A1 Mar. 11, 2010

(30) Foreign Application Priority Data

Sep. 5, 2008 (KR) ..... 10-2008-0087833

(51) Int. Cl.
*H01H 67/02* (2006.01)

(52) U.S. Cl. ..... 335/126; 335/131

(58) Field of Classification Search ..... 335/126, 335/131, 179
See application file for complete search history.

(56) References Cited

U.S. PATENT DOCUMENTS

| | | | | | |
|---|---|---|---|---|---|
| 4,604,597 | A * | 8/1986 | Bogner et al. | ..... | 335/127 |
| 4,755,781 | A * | 7/1988 | Bogner | ..... | 335/131 |
| 4,887,056 | A * | 12/1989 | Kajino et al. | ..... | 335/126 |
| 5,252,938 | A * | 10/1993 | Bishop | ..... | 335/274 |
| 5,394,128 | A * | 2/1995 | Perreira et al. | ..... | 335/126 |
| 5,519,370 | A * | 5/1996 | Perreira et al. | ..... | 335/154 |
| 5,521,566 | A * | 5/1996 | Krubsack et al. | ..... | 335/126 |
| 5,677,656 | A * | 10/1997 | Mauch et al. | ..... | 335/126 |
| 5,892,194 | A * | 4/1999 | Uotome et al. | ..... | 218/68 |
| 5,909,067 | A * | 6/1999 | Liadakis | ..... | 310/14 |
| 6,911,884 | B2 * | 6/2005 | Uotome et al. | ..... | 335/132 |
| 2004/0027776 | A1 * | 2/2004 | Uotome et al. | ..... | 361/160 |
| 2004/0032309 | A1 * | 2/2004 | Kajino et al. | ..... | 335/126 |
| 2006/0050466 | A1 * | 3/2006 | Enomoto et al. | ..... | 361/160 |

FOREIGN PATENT DOCUMENTS

| | | |
|---|---|---|
| JP | 50-27959 | 3/1975 |
| JP | 57-111926 | 7/1982 |
| JP | 08-329759 | 12/1996 |
| JP | 2005-071915 | 3/2005 |
| JP | 2007-287526 | 11/2007 |
| KR | 100854381 | 9/2008 |

* cited by examiner

*Primary Examiner* — Lincoln Donovan
*Assistant Examiner* — Alexander Talpalatskiy
(74) *Attorney, Agent, or Firm* — Lee, Hong, Degerman, Kang & Waimey

(57) ABSTRACT

A relay comprises: a solenoid; a hermetically sealed chamber mounted at a lower end thereof with a cylinder into which a center portion of the spool is inserted, mounted at an upper end thereof with a pair of stationary terminals each provided at a stationary contact point and filled therein with insulating gas to be coupled at an upper portion of the spool; an insulation member insulating the chamber and the stationary terminals; a movable unit including a shaft, a conductive movable terminal, and a pair of movable contact points; a restoring spring to pull the shaft toward the lower surface of the cylinder; and an insulated sliding guide to guide the movable unit that is moved by the solenoid and the restoring spring.

6 Claims, 4 Drawing Sheets

– Prior Art –

[Fig. 2]

RELAY

CROSS-REFERENCE TO RELATED APPLICATION

The present application is based on, and claims priority from, Korean Application Numbers 10-2008-0087833, filed Sep. 5, 2008, the disclosure of which is incorporated by reference herein in its entirety.

BACKGROUND

The following description relates to a relay, and more particularly to a relay capable of causing a movable contact point to accurately and stably contact a stationary contact point for conduction even after an arc is generated.

A relay is an electromagnetic switching apparatus for an electric relaying operation, and generally defines a connection switching apparatus capable of conducting or interrupting a main circuit in response to a small input current change. Various types of relays are available including a contact relay, a non-contact relay, a pressure relay and an optical relay but the contact relay is mostly used for automobile indicator lights and wiper motors of an automobile as the contact relay has a relatively simple structure.

FIG. 1 illustrates an exemplary contact relay, and as shown in FIG. 1, the contact relay includes an electric magnet 1, a movable rod 2 movably sucked by operation of the electric magnet 1, a movable contact point 3 disposed at a distal end of the movable rod 2, upper/lower stationary contact points 4, 5 for opening and closing a circuit by being contacted to the movable contact point 3, and restoring lever 6 coupled at the other end of the movable rod 2 and resiliently moving in an opposite direction from the movably sucked movable rod 2. The conventional relay thus configured is operated in the following manner.

That is, when a current is introduced into the electric magnet 1, the electric magnet 1 sucks the movable rod 2 to cause the movable contact point 3 disposed at the distal end of the movable rod 2 to be brought into contact with the lower stationary contact point 5. The contact between the movable contact point 3 and the lower stationary contact point 5 causes the current to flow from a movable terminal (not shown) connected to the movable rod 2 to a stationary terminal (not shown) connected to the lower stationary contact point 5, whereby a main circuit connected to a relay is conducted.

However, when there is a need to interrupt the main circuit for protecting or controlling the main circuit against damage by an over-current, the current is no more introduced into the electric magnet 1. When the current is not introduced into the electric magnet 1 any more, the electric magnet 1 can no more pull the movable rod 2, and the movable contact point 3 mounted on one end of the movable rod 2 is disengaged from the lower stationary contact point 5 by the restoring lever 6.

When the movable contact point 3 is disengaged from the lower stationary contact point 5 to disable the movable contact point 3 and the lower stationary contact point 5 to contact each other, the relay is opened to interrupt the main circuit connected to the relay. At this time, the movable contact point 3 comes to contact the upper stationary contact point 4 to cause the current to flow to another point on the main circuit, whereby the main circuit may be controlled.

Meanwhile, the restoring lever 6 may be replaced by an elastic member like a spring, and when the movable contact point 3 is instantly disengaged from the lower stationary contact point 5, an arc may be generated. Furthermore, the relay may be filled therein with an insulating gas such as $SF_6$ in order to distinguish the arc promptly.

However, the thus described conventional relay suffers from a drawback in which the relay is not properly operated if the movable rod 2 develops a problem because the movable contact point 3 and the upper/lower stationary contact points 4, 5 are engaged or disengaged (brought into contact or out of contact) via the movable rod 2.

That is, if a hinged part of the movable rod 2 coupled to the restoring lever 6 is twisted when an arc is generated, there may be generated a problem of the movable contact point 3 not being brought into contact with the upper/lower stationary contact points 4, 5 even if the current is introduced into the electric magnet 1 again.

The conventional relay suffers from another drawback in that the movable rod 2 may not be guidably pulled to or disengaged from the electric magnet 1 to cause the movable contact point 3 disposed at one end of the movable rod 2 to be accurately brought into contact with the upper/lower stationary contact points 4, 5.

These drawbacks may generate resistance at a portion where the movable contact point 3 and the upper/lower stationary contact points 4, 5 are brought into contact, which may further give rise to an unexpected heat to damage the movable contact point 3 and the upper/lower stationary contact points 4, 5.

Furthermore, even if the conventional relay is mounted with a structure that guides the movable rod 2, the structure must be made of an insulating material such as plastic or the like because the structure is not allowed to electrically conduct the movable rod 2. However, the insulating material such as plastic usually lacks a good wear and tear, such that dust may be generated from the structure by contact friction when the movable rod 2 moves. The dust of the structure may stick to the movable contact point 3 or the upper/lower stationary contact points 4, 5 to become an obstacle to the electrical conduction.

SUMMARY

Accordingly, the present disclosure has been conceived in light of the foregoing situation and aims at providing a relay capable of improvingly miniaturizing a coupled structure mounted with a movable contact point, and stably and accurately conducting and contacting the movable contact point and stationary contact points each other even after an arc is generated.

In order to achieve the object, a relay comprises: a solenoid including a spool, a coil wound on an outer periphery of the spool, and a pair of power connecting terminals provided at one end of a spool for providing a current to the spool; a hermetically sealed chamber mounted at a lower end thereof with a cylinder into which a center portion of the spool is inserted, mounted at an upper end thereof with a pair of stationary terminals each provided at a stationary contact point and filled therein with insulating gas to be coupled at an upper portion of the spool; an insulation member mounted at an upper end of the chamber for insulating the chamber and the stationary terminals; a movable unit including a shaft inserted into the cylinder to move toward an inner upper surface of the chamber when the solenoid is operated, a conductive movable terminal vertically coupled to an upper end of the shaft, and a pair of movable contact points provided at an upper end of the movable terminal and electrically conducted by being selectively contacted to each stationary contact point; a restoring spring coupled at one end thereof to a lower end of the shaft and supportively fixed at the other end to a lower surface of the cylinder to pull the shaft toward the lower surface of the cylinder; and an insulated sliding guide provided inside the chamber to guide the movable unit that is moved by the solenoid and the restoring spring.

In some exemplary implementations, the movable unit may further include a contact spring supportively fixed at one end thereof to an inner lower surface of the chamber, and supportively fixed at the other end thereof to the movable terminal, and constantly keeping a contact pressure between the movable contact points through an operation of pushing the movable terminal to an inner upper end of the chamber.

In some exemplary implementations, the sliding guide may further include a guide pin provided at a surface contacting the movable terminal, wherein the guide pin is made of a metal.

In some exemplary implementations, the insulation member may be made of ceramic, and the movable contact point and the stationary contact points may be made of molybdenum alloy.

There is an advantage in the relay thus constructed according to the present disclosure in that the shaft of the movable unit vertically and horizontally moves along an inner circumferential surface of the cylinder to cause the movable terminal coupled to the shaft to stably to drive without being inclined or twisted.

There is another advantage in that the movable contact point provided at the movable unit is conducted by being accurately and stably brought into contact with the stationary contact point of the stationary terminal.

There is still another advantage in that the relay is further installed with a pressure spring that constantly maintain a contact pressure between the movable contact point and the stationary contact point to enable an accurate and stable conduction between the movable contact point and the stationary contact point.

There is still another advantage in that the sliding guide is capable of guiding the driving of the movable unit disposed with the movable contact point to enable an accurate and stable conduction between the movable contact point and the stationary contact point.

There is still another advantage in that a guide pin is provided at a surface contacted by the sliding guide and the movable terminal to enable an accurate and stable conduction between the movable contact point and the stationary contact point by preventing generation of dust that is caused by friction between the sliding guide and the movable terminal.

There is still another advantage in that damage caused by unexpected heat that is generated by conduction from and inaccurate contact between the movable contact point and the stationary contact point can be prevented, because the movable contact point and the stationary contact point are accurately and stably brought into contact.

DETAILED DESCRIPTION

Now, the relay according to the present disclosure will be described in detail with reference to the accompanying drawings.

Figure 1:
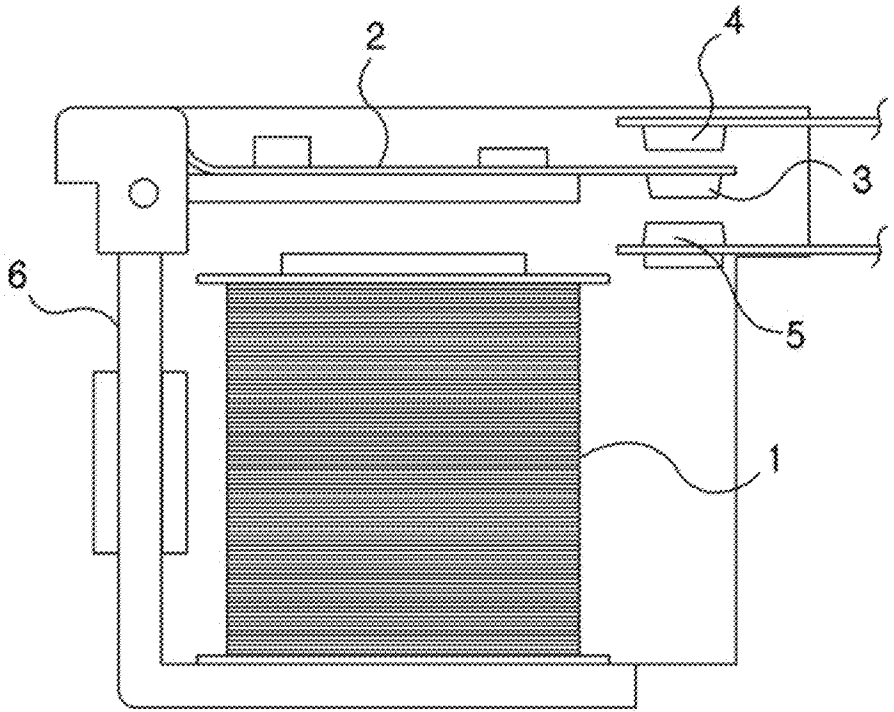
FIG. 1 is a front view of the conventional relay.
Figure 2:
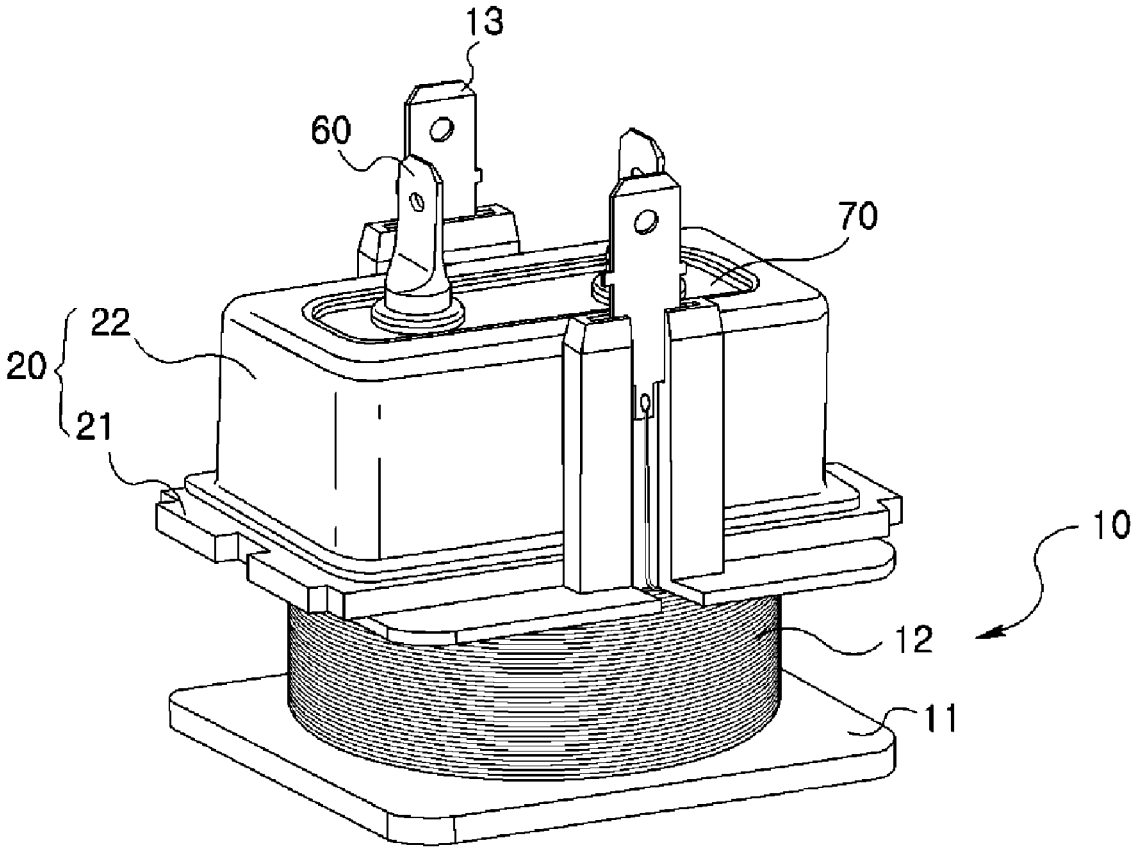
FIG. 2 is a perspective view of a relay according to the present disclosure.
Figure 3:
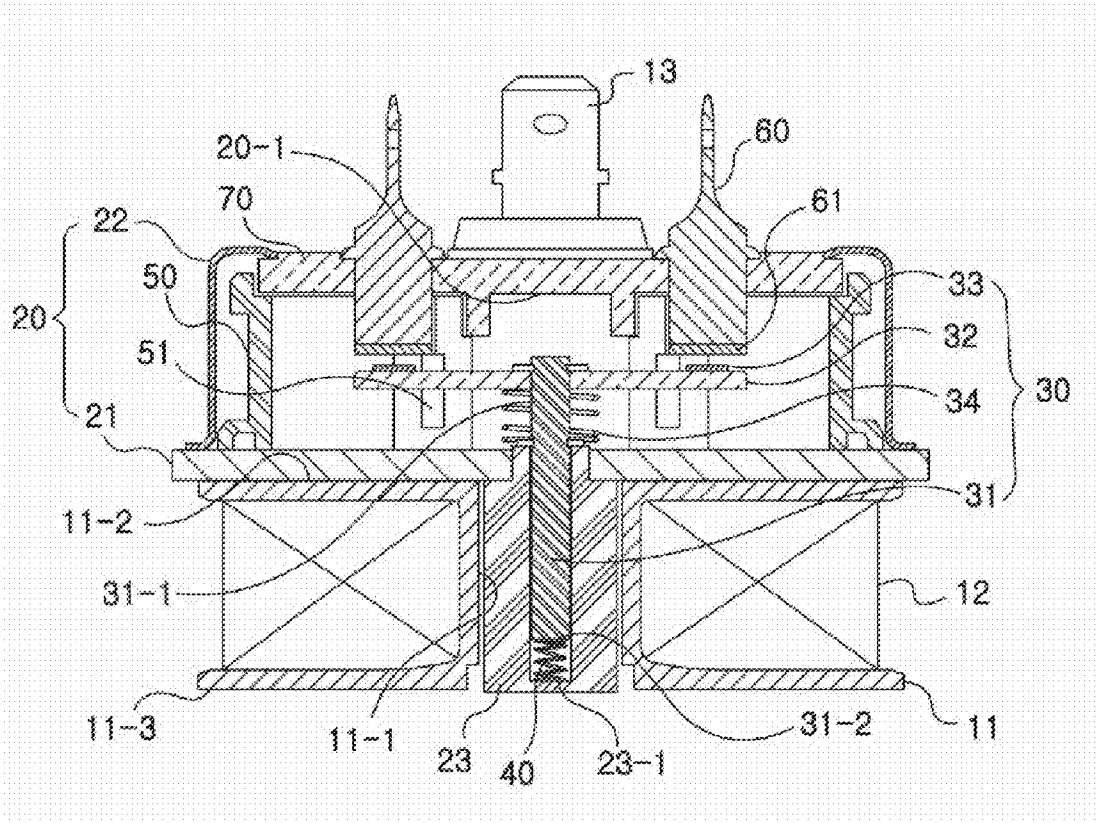
FIG. 3 is a cross-sectional view of a relay according to the present disclosure.
Figure 4:
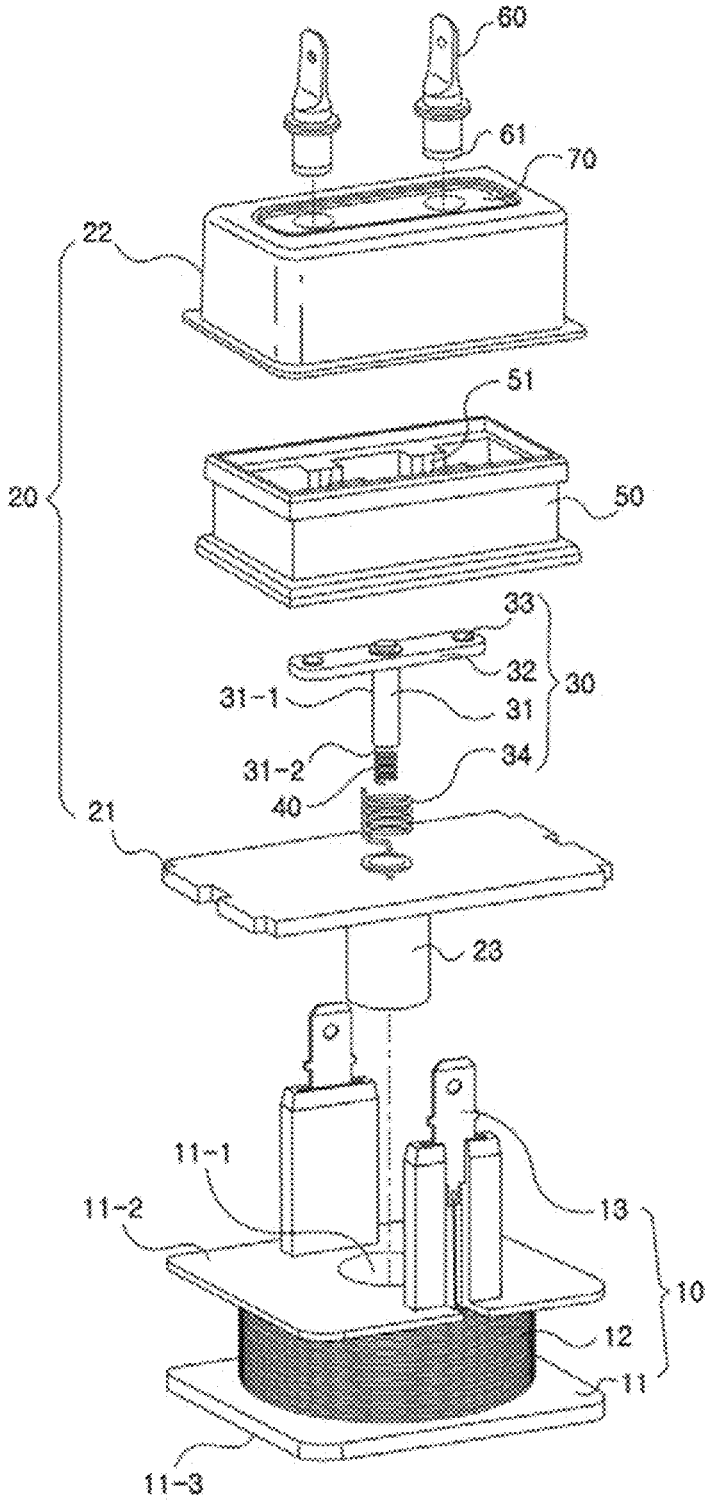
FIG. 4 is an exploded perspective view of a relay according to the present disclosure.

FIG. 2 is a perspective view of a relay according to the present disclosure, FIG. 3 is a cross-sectional view of a relay according to the present disclosure, and FIG. 4 is an exploded perspective view of a relay according to the present disclosure.

Referring to FIGS. 2, 3 and 4, a relay according to the present disclosure may include a solenoid 10, a chamber 20, a movable unit 30, a restoring spring 40, a sliding guide 50, a stationary terminal 60 and an insulation member 79.

The solenoid 10 for moving the movable unit 30 (described later) may include a spool 11, a coil 12 wound on an outer periphery of the spool 11, and a power connection terminal 13 provided to supply an electric power to the coil.

The spool 11 may include a cylindrical center 11-1, an upper plate 11-2 and a lower plate 11-3 with each of the upper plate 11-2 and the lower plate 11-3 facing each other across the center. The center 11-1 is lengthwise formed with a hole into which a cylinder 23 installed at the lower end of the chamber (described later) is inserted. A coil 12 is wound on an outer periphery of the center 11-1 of the spool.

Furthermore, the coil is introduced with a current via the power connection terminal 13. In a case the introduced current flows along the coil 12, a magnetic field is formed around the coil 12 to generate a solenoid effect.

The power connection terminal 13 is provided at one side of the spool 11, and connected to an external circuit by being protruded outside of a case (not shown) surrounding the relay along with the stationary terminal 60.

The power connection terminal 13 is formed in a pair of terminals to allow the current to flow in and outside, and takes the shape that corresponds to that of the terminal so as to be directly connected to a terminal of an external circuit.

Meanwhile, the chamber 20 is an area where an arc is to be distinguished that is generated by departure of the movable contact point 33 (described later) from the stationary contact point 61 as the movable unit 30 (described later) is moved. The chamber 20 may include a base plate 21 coupled to an upper surface 11-2 of the spool 11 and a cover 22 that covers the base plate 21.

The base plate 21 is formed thereunder with a cylinder 23. The cylinder 23 is inserted into the center 11-1 of the spool 11. The cylinder 23 is inserted by a shaft 31 (described later) to be driven therein by the restoring spring (described later).

The cylinder 23 serves to allow the movable contact point (33. described later) and the stationary contact point 61 to be accurately brought into contact by guiding the movable unit (30. described later) to be driven stably.

That is, because the shaft 31 comprising the movable unit 30 almost touches an inner circumferential surface of the cylinder 23 and drives up and down, the movable terminal 32 fastened to the shaft 31 is in turn stably driven up and down without being inclined or twisted during the driving operation, whereby the movable contact point 33 provided at the movable terminal 32 is accurately brought into contact with the stationary contact point 61.

The base plate 21 is laterally formed with a protruder that is connected to a case, whereby the chamber 20 and the solenoid 10 coupled to the chamber 20 are tightly coupled to the case.

The cover 22 may be formed thereon with a pair of stationary terminals 60 each provided with a stationary contact point 61. At this time, the stationary contact point 61 is the one that is in contact with the movable contact point 33, and is made of molybdenum alloy having a good heat-resistance so as not to be damaged by heat of the arc. Furthermore, the stationary contact point 60 is also formed with a pair of terminals where a current can flow in and out, and takes the shape that corresponds to that of the terminal so as to be directly connected to a terminal of a main circuit.

Furthermore, the chamber 20 is filled therein with an insulation gas for extinguishing arc quickly. $SF_6$ is used for the insulation gas in most of cases, and is put into the chamber after the base plate 21 and the cover 22 are coupled and air inside the chamber is removed.

Meanwhile, the insulation member 70 is installed on an upper end 20-1 of the cover 22 comprising the chamber 20 in order to insulate the chamber 20 from the stationary terminal 60.

Generally, a metal having a good durability is used for the chamber 20 in order to prevent the chamber 20 from being damaged by arc.

However, in a case where the chamber 20 is made of a metal, there is a risk of the relay being improperly operated due to electrical conduction with the stationary terminal 60, such that an insulation member 70 is installed at an upper end 20-1 of the cover 22 to insulate the chamber 20 from the stationary terminal 60, whereby the relay is prevented from operating improperly due to electrical conduction with the stationary terminal 60.

The insulation member 70 may be installed only at a surface contacted by the chamber 20 and the stationary terminal 60, but may be mounted at an upper front surface of the cover 22 comprising the chamber for a full complete insulation.

Preferably, the insulation member 70 may be also made of ceramic. That is, the ceramic has a physical property of maximum insulation temperature of 180° C. which is an insulationable temperature in a high temperature, such that even if the temperature inside the chamber 20 rises due to arc of high temperature, the insulation member 70 can fully perform the insulation.

The movable unit 30 plays a major role in the relay interdicting the current flowing to the main circuit or allowing the current to flow again in the main circuit. The movable unit 30 having the above-mentioned role includes a shaft 31 that is inserted into the cylinder 23, a movable terminal 32 vertically fastened on an upper surface 31-1 of the shaft 31, and a pair of movable contact points 33 provided at an upper end of the movable terminal 32 for being conducted by being selectively contacted to each stationary contact point 61.

At this time, the shaft 31 moves toward an inner upper end 20-1 of the chamber 20 when the solenoid is operated. When a current is introduced into the coil 12, a magnetic field is formed around the coil 12 to generate a solenoid effect. The shaft 31 centrally mounted on the spool 11 is pushed up by the solenoid effect. The principle of the shaft 31 being pushed up is the same as that of a plunger comprising a solenoid valve being pushed up from a center of a coil.

Furthermore, the movable terminal 32 is vertically fastened on an upper surface 31-1 of the shaft 31 and moves along with the shaft 31. That is, the movable terminal 32 is provided horizontally with an inner upper surface 20-1 of the chamber 20 that is faced by the shaft 31 to accurately contact the stationary contact points 60 mounted on an upper end of the chamber 20.

The movable terminal 32 is made of conductive material so that a current introduced into any one stationary contact point can flow into the remaining other stationary contact point in the pair of stationary contact points 61.

The movable contact point 33 is provided in pairs on an upper end of the movable terminal 32 so as to be selectively brought into contact and conducted with each stationary contact point 61. The movable contact point 33 is made of molybdenum alloy having a good heat-resistance in the same way as that of the stationary contact point 61 in order to protect against the heat of arc.

Furthermore, the movable unit 30 further includes a pressure spring 34, one end of which is supportively fixed at an inner lower surface of the chamber 20 and the other end of which is supportively fixed at the movable terminal 32 to push the movable terminal 32 up to an inner upper end 20-1 of the chamber 20. The pressure spring 34 removes a gap that is generated by an incomplete contact between the movable contact point 33 and the stationary contact point 61 to thereby maintain a contact pressure between the movable contact point 33 and the stationary contact point 61. Accordingly, the movable contact point 33 and the stationary contact point 61 are stably and accurately contacted by the pressure spring 34.

Meanwhile, the restoring spring 40 disengages the contacted movable contact point 33 and the stationary contact point 61 in order to protect against the damage of the main circuit caused by over-current or to control the main circuit. One end of the restoring spring 40 is coupled to a lower surface 31-2 of the shaft 31 while the other end of the restoring spring 40 is supportively fixed at a lower surface 23-1 of the cylinder 23.

In other words, when a current is introduced into the coil 11, the shaft 31 is pushed up to allow the restoring spring 40 coupled to the shaft 31 to elongate. However, if the current is no longer introduced into the coil 11, the shaft 31 is not pushed up to allow the restoring spring 40 to shrink to an initial state.

When the restoring spring 40 is shrunk, the movable terminal 32 fastened to the shaft 31 descends towards the inner lower surface of the chamber 20 and the movable contact point 33 provided at the movable terminal 32 also descends along with the movable contact point 33 to disengage the movable terminal 32 from the stationary terminal 61, whereby there is generated no more electrical conduction therebetween.

However, if the current is introduced into the coil 11 again, the shaft 31 is pushed up again to elongate the restoring spring 40 again. At this time, the force that pushes up the shaft 31 in response to solenoid 10 should be larger than the elasticity of the restoring spring 40, the elastic modulus of the restring spring 40 must be adjusted in consideration of intensity of the solenoid 10.

Meanwhile, the sliding guide 50 serves to guide the movable unit 30 that is moved by the solenoid 10 and the restoring spring 40, and to prevent the movable terminal 32 of the movable unit 30 from being moved back and forth and to the left and right. That is, the sliding guide 50 takes the shape of wrapping a surrounding of the movable terminal 32. The sliding guide 50 also takes the shape of a rail-shaped guide lengthily formed in the same direction of the moving direction of the movable terminal 32.

The sliding guide 50 must be formed with an insulating material lest the current flowing in the movable terminal 32 should be conducted. The insulating material of the sliding guide 50 may be used with plastic having a good heat-resistance such as alkyd resin, epoxy resin, cross-linking polyurethane resin, silicon alkyd resin or the like.

The plastic sliding guide 50 may generate a dust caused by friction as the movable terminal 32 moves. The dust may prevent the movable contact point 33 or the stationary contact points 61 from being conducted by being stuck thereto. Therefore, the sliding guide 50 may further include a guide pin 51 on a surface contacting the movable terminal 32. That is, attachment of the guide pin 51 having a good friction-resistance to the surface contacting the movable terminal 32 can prevent the generation of dust of the sliding guide 50.

Now, operation of the relay thus configured according to the present disclosure will be described in detail with reference to the accompanying drawings.

For a starter, a pair of stationary terminals is connected to a terminal (not shown) of the main circuit, and a pair of power terminals 13 is connected to a terminal (not shown) of an external circuit, whereby the relay is connected to the main circuit and the external circuit. The main circuit is intended to prevent an unexpected damage that might be generated by over-current or to control the operation of the relay.

Furthermore, the external circuit is intended to control a circuit for controlling the relay, and may be connected along with other circuit breakers such as gas insulation breaker (GIS) and the like.

When a current is introduced into the power connection terminal 13 and the stationary terminal 61 in the relay connected to the main circuit and the external circuit, the following operation ensues.

If the current is introduced via any one power connection terminal out of a pair of power connection terminals 13, the current flows along the coil 11 to discharge out of the other power connection terminal. At this time, a magnetic field is generated around the coil 11 and simultaneously the solenoid effect is generated. The shaft 31 is raised up to the inner upper end 20-1 of the chamber 20 in response to the solenoid effect. At the same time, the movable terminal 32 coupled to the shaft 31 is also raised to the inner upper end 20-1 of the chamber 20 to bring the movable contact point 33 provided at the movable terminal 32 and the stationary contact points 61 into contact.

At the same time, if a current is introduced into any one stationary terminal out of the pair of stationary terminals 61, the current passes the stationary contact point 61 to flow in any one movable contact point out of the pair of movable contact points 33. The current flows in the movable terminal 32 provided at the movable contact points to flow to another stationary terminal via another movable contact point. Once the current flows like this manner, the main circuit comes to be conductive continuously.

However, if an unexpected over-current flows in the main circuit, or there is a need of controlling the main circuit by interrupting the current in the main circuit, current is not introduced from the external circuit to the power connection terminal 13 and the relay is operated in the following way to prevent the main circuit from being conductive any more.

If no current flows into the power connection terminal 13, no magnetic field is generated about the coil 11 to subsequently remove the solenoid effect at the same time. If no solenoid effect is generated, the shaft 31 is no longer pushed and raised to descend towards the lower end surface 23-1 of the cylinder 23. At this time, there may be a chance of the shaft 31 not descending towards the lower end surface 23-1 of the cylinder 23 along a direction where the relay is installed, to necessitate the installation of the restoring spring 40.

That is, although the restoring spring 40 is elongated when the shaft 31 is pushed up, the restoring spring 40 may shrink again when the shaft 31 is no longer raised up, such that the restoring spring 40 serves to descend the shaft 31 towards the lower end surface 23-1 of the cylinder 23.

If the shaft 31 is lowered towards the lower end surface 23-1 of the cylinder 23, the movable terminal 32 coupled to the shaft 31 simultaneously descends to allow the movable contact point 33 provided at the movable terminal 32 and the stationary contact points 61 to disengage. Once the movable contact point 33 and the stationary contact points 61 are disengaged, the relay transitions to the open state to make the main circuit connected to the relay non-conductive.

At this time, the time in which the movable contact point 33 and the stationary contact points 61 are disengaged is very short, and an arc may be instantly generated but the arc is distinguished by the insulation gas such as $SF_6$.

The instantly-generated arc may have an influence on the motion of the movable unit 30, but the movable unit 30 is further stabilized by the sliding guide 50.

Meanwhile, if the current is introduced again to the power connection terminal 13 for conducting the main circuit, the relay is operated again, as mentioned above, to make the main circuit conductive. At this time, the gap between the movable contact point 33 and the stationary contact points 61 created by the erstwhile arc is removed to maintain the contact pressure between movable contact point and the stationary contact points at a constant level. The constantly-maintained contact pressure now functions to accurately contact the movable contact point 33 and the stationary contact points 61.

Any reference in this specification to "one embodiment," "an embodiment," "exemplary embodiment," etc., means that a particular feature, structure, or characteristic described in connection with the embodiment is included in at least one embodiment of the disclosure. The appearances of such phrases in various places in the specification are not necessarily all referring to the same embodiment. Further, when a particular feature, structure, or characteristic is described in connection with any embodiment, it is submitted that it is within the purview of one skilled in the art to affect such feature, structure, or characteristic in connection with others of the embodiments.

Although embodiments have been described with reference to a number of illustrative embodiments thereof, it should be understood that numerous other modifications and embodiments can be devised by those skilled in the art that will fall within the spirit and scope of the principles of this invention. More particularly, various variations and modifications are possible in the component parts and/or arrangements of the subject combination arrangement within the scope of the disclosure, the drawing and the appended claims. In addition to variations and modifications in the component parts and/or arrangements, alternative uses will also be apparent to those skilled in the art.

What is claimed is:

1. A relay, comprising:

a solenoid, comprising:

a spool;

a coil wound on an outer periphery of the spool; and a pair of power connecting terminals provided at one end of the spool and configured for providing a current to the spool;

a hermitically sealed, insulating gas-filled chamber coupled to an upper portion of the spool, the chamber comprising:

a cylinder at a lower end thereof positioned in a center portion of the spool; and a pair of stationary terminals, wherein each of the stationary terminals includes a stationary contact point at an upper end thereof;

an insulation member mounted at an upper end of the chamber and configured for insulating the chamber and the stationary terminals;

a movable unit, comprising:

a shaft inserted into the cylinder and configured for moving toward an inner upper surface of the chamber when the solenoid is operated;

a conductive movable terminal vertically coupled to an upper end of the shaft, and a pair of movable contact points provided at an upper end of the movable terminal and configured for being electrically conducted by being selectively contacted to each stationary contact point;

a restoring spring coupled at one end thereof to a lower end of the shaft and supportively fixed at the other end to a lower surface of the cylinder, the restoring spring configured for pulling the shaft toward the lower surface of the cylinder; and an insulated sliding guide provided inside the chamber and surrounding a perimeter of the movable terminal, the insulated sliding guide configured for guiding the movable unit as it is moved by the solenoid and the restoring spring.

2. The relay of claim 1, wherein the movable unit further comprises:

a contact spring supportively fixed at one end thereof to an inner lower surface of the chamber, and supportively fixed at the other end thereof to the movable terminal, wherein the contact spring is configured for constantly providing contact pressure between the movable contact points by pushing the movable terminal toward an inner upper end of the chamber.

3. The relay of claim 1, wherein the sliding guide comprises a guide pin provided at a surface thereof, the guide pin configured for contacting the movable terminal.

4. The relay of claim 3, wherein the guide pin is made of a metal.

5. The relay of claim 1, wherein the insulation member is made of ceramic.

6. The relay of claim 1, wherein the movable contact points and the stationary contact points are made of molybdenum alloy.

* * * * *